US010744813B2

(12) United States Patent
Parker

(10) Patent No.: US 10,744,813 B2
(45) Date of Patent: Aug. 18, 2020

(54) WRITING INSTRUMENT HAVING AN ELONGATED TIP WITH A CURVATURE SYSTEM

(71) Applicant: Clarence Parker, Holly Springs, NC (US)

(72) Inventor: Clarence Parker, Holly Springs, NC (US)

( * ) Notice: Subject to any disclaimer, the term of this patent is extended or adjusted under 35 U.S.C. 154(b) by 0 days.

(21) Appl. No.: 16/351,450

(22) Filed: Mar. 12, 2019

(65) Prior Publication Data

US 2019/0291499 A1 Sep. 26, 2019

Related U.S. Application Data

(60) Provisional application No. 62/648,346, filed on Mar. 26, 2018.

(51) Int. Cl.

| | |
|---|---|
| ***B43K 17/00*** | (2006.01) |
| ***B43K 5/14*** | (2006.01) |
| ***B43K 23/12*** | (2006.01) |
| ***B43K 3/00*** | (2006.01) |
| ***B43K 8/18*** | (2006.01) |
| ***B43K 8/14*** | (2006.01) |
| ***B05C 17/005*** | (2006.01) |

(52) U.S. Cl.

CPC ..... *B43K 17/005* (2013.01); *B05C 17/00586* (2013.01); *B43K 3/00* (2013.01); *B43K 5/14* (2013.01); *B43K 8/143* (2013.01); *B43K 8/18* (2013.01); *B43K 23/12* (2013.01)

(58) Field of Classification Search

CPC ..... B43K 17/005; B43K 5/14; B43K 23/12; B43K 3/00; B43K 29/00; B43K 13/00; B43K 13/005; B43K 15/00; B43K 8/18; B43K 8/143; B43K 8/146; B43K 23/004; A61M 35/0006; A46B 11/0075; B05C 17/00586

See application file for complete search history.

(56) References Cited

U.S. PATENT DOCUMENTS

| | | | | | |
|---|---|---|---|---|---|
| 2,061,059 | A * | 11/1936 | Carlson | B43K 5/14 | 401/134 |
| 2,639,506 | A | 5/1953 | Lory | | |
| 5,152,742 | A * | 10/1992 | Simpson | A45D 34/042 | 401/132 |
| 5,342,136 | A * | 8/1994 | Fukami | B43K 8/03 | 401/134 |
| 5,564,849 | A | 10/1996 | Greer, Jr. | | |
| 5,829,976 | A * | 11/1998 | Green | A61C 3/005 | 433/89 |
| 6,238,120 | B1 * | 5/2001 | Mark | A45D 19/02 | 401/134 |

* cited by examiner

*Primary Examiner* — David J Walczak
(74) *Attorney, Agent, or Firm* — Charles Runyan

(57) ABSTRACT

A writing instrument system including an elongated tip having a firm, felt or plastic nib and a piercing tip. The elongated tip includes a curvature that resembles a shape of a dolphin and the nib is positioned at a first-end of the elongated tip for distributing ink to a surface in a controlled manner. The elongated tip is in fluid communication with the nib. The elongated tip also includes the piercing tip which is able to penetrate an ink cartridge or tube of a pen and be removably affixed to a pen. The piercing tip is in fluid communication with the elongated tip and allows ink to flow from a penetrated ink cartridge or tube through the elongated tip to the nib where it can be applied to a surface.

19 Claims, 5 Drawing Sheets

WRITING INSTRUMENT HAVING AN ELONGATED TIP WITH A CURVATURE SYSTEM

CROSS REFERENCE TO RELATED APPLICATION

The present application is related to and claims priority to U.S. Provisional Patent Application No. 62/648,346 filed Mar. 26, 2018, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. Field of the Invention

The present invention relates generally to the field of coating instruments with material supply and more specifically relates to writing instruments.

2. Description of Related Art

Many people can find using a writing implement with ink to be frustrating as it can be difficult to prevent smearing the ink. Left-handed people, in particular, have difficulty writing from left to right without smudging and also may not be able to clearly see what they are writing. Artists and illustrators also can experience difficulty drawing in detail without smearing or smudging. These issues are caused by the shape of the typical writing instrument. A suitable solution is desired.

U.S. Pat. No. 2,639,506 to Lory George relates to a curve pen adapter. The described curve pen adapter includes a device which permits a straight-bladed pen to serve satisfactorily either as a ruling pen or as a curve pen regardless of whether it is a single straight bladed ruling pen or a straight-bladed railroad requires only one instrument to serve either a ruling pen or curve pen. FIG. 2 shows a side view of the pen assembly with the hinge bent in position to convert the straight blades of railroad pen into a double curve pen.

BRIEF SUMMARY OF THE INVENTION

In view of the foregoing disadvantages inherent in the known coating instruments with material supply art, the present disclosure provides a novel writing instrument system. The general purpose of the present disclosure, which will be described subsequently in greater detail, is to provide a writing instrument having an elongated tip with a curvature which is superior to others in that it effectively provides a writing instrument with an improved form, allowing for increased control and comfort.

A writing instrument system is disclosed herein. The writing instrument system includes an elongated tip having a nib and a piercing tip. The nib is positioned at a first-end of the elongated tip and the piercing tip is positioned at a second-end of the elongated tip. The elongated tip is in fluid communication with the nib. The piercing tip is configured to penetrate an ink cartridge of a pen such that the elongated tip is affixed to the pen. The piercing tip is in fluid communication with the elongated tip and allows ink to flow from a penetrated the ink cartridge or tube through the elongated tip to the nib; Ink is then evenly dispensed and applied to a surface. The elongated tip is an adapter and includes a curvature forming a hook-shape and allowing a user to have a clear view of where the nib contacts the surface providing increased accuracy and precision.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a writing instrument system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to coating instruments with material supply and more particularly to a writing instrument system as used to improve the use of writing instruments by providing an ergonomic pen attachment.

In one embodiment of the present invention, a writing instrument having an elongated tip with a curvature may comprise an elongated tip attachment for an ink pen. The elongated tip has a curvature that resembles the shape of a dolphin and includes a firm, felt or plastic nib for distributing ink to a surface in a controlled manner. The elongated tip is in fluid communication with the nib. The elongated tip also includes a piercing tip which is able to penetrate an ink cartridge or tube of a pen and be removably affixed to a pen. The piercing tip is in fluid communication with the elongated tip and allows ink to flow from a penetrated ink cartridge or tube through the elongated tip to the nib where it can be applied to a surface. Also included is a specially-shaped cap formed to allow the cap to be placed over the elongated tip and be removably affixed to the body of a pen which has the attachment installed. The curvature of the elongated tip allows a user to have a clear view of the point where the nib makes contact with a surface, which improves control and comfort of the user.

Figure 1:
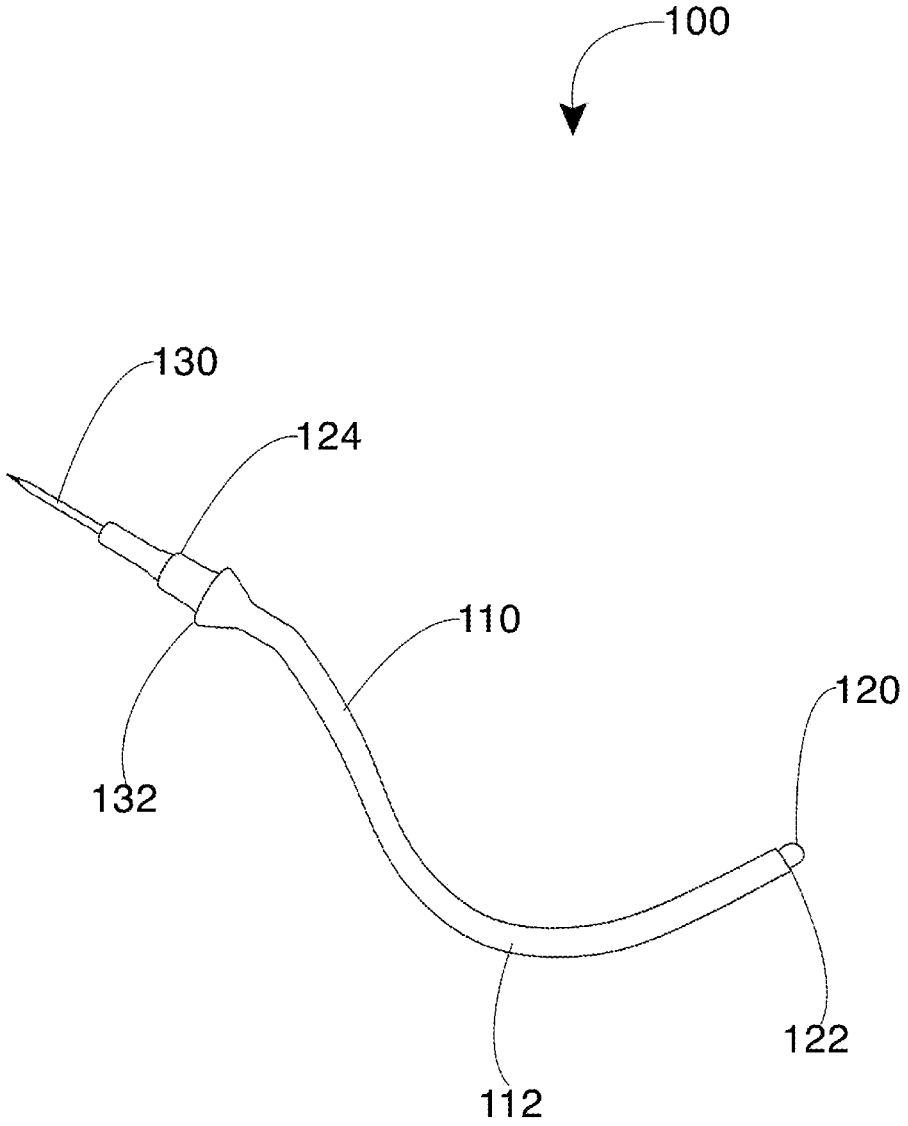
FIG. 1 is a perspective view of the writing instrument system during an 'in-use' condition, according to an embodiment of the disclosure.

Referring now more specifically to the drawings by numerals of reference, there is shown in FIGS. 1-5, various views of a writing instrument system 100. FIG. 1 shows a writing instrument system 100 according to an embodiment of the present disclosure. As illustrated, the writing instrument system 100 may include an elongated tip 110 having a nib 120 and a piercing tip 130. The nib 120 is positioned at a first-end 122 of the elongated tip 110 and the piercing tip 130 is positioned at a second-end 132 of the elongated tip 110. The elongated tip 110 is in fluid communication with the nib 120. The piercing tip 130 is configured to penetrate an ink cartridge 10 of a pen 20 such that the elongated tip 110 is affixed to the pen 20. The piercing tip 130 is in fluid communication with the elongated tip 110 and allows ink to flow from a penetrated ink cartridge 10 through the elongated tip 110 to the nib 120 where the ink can be evenly dispensed and applied to a surface. The elongated tip 110 is an adapter and includes a curvature 112 allowing a user to have a clear view of where the nib 120 contacts the surface.

Figure 2:
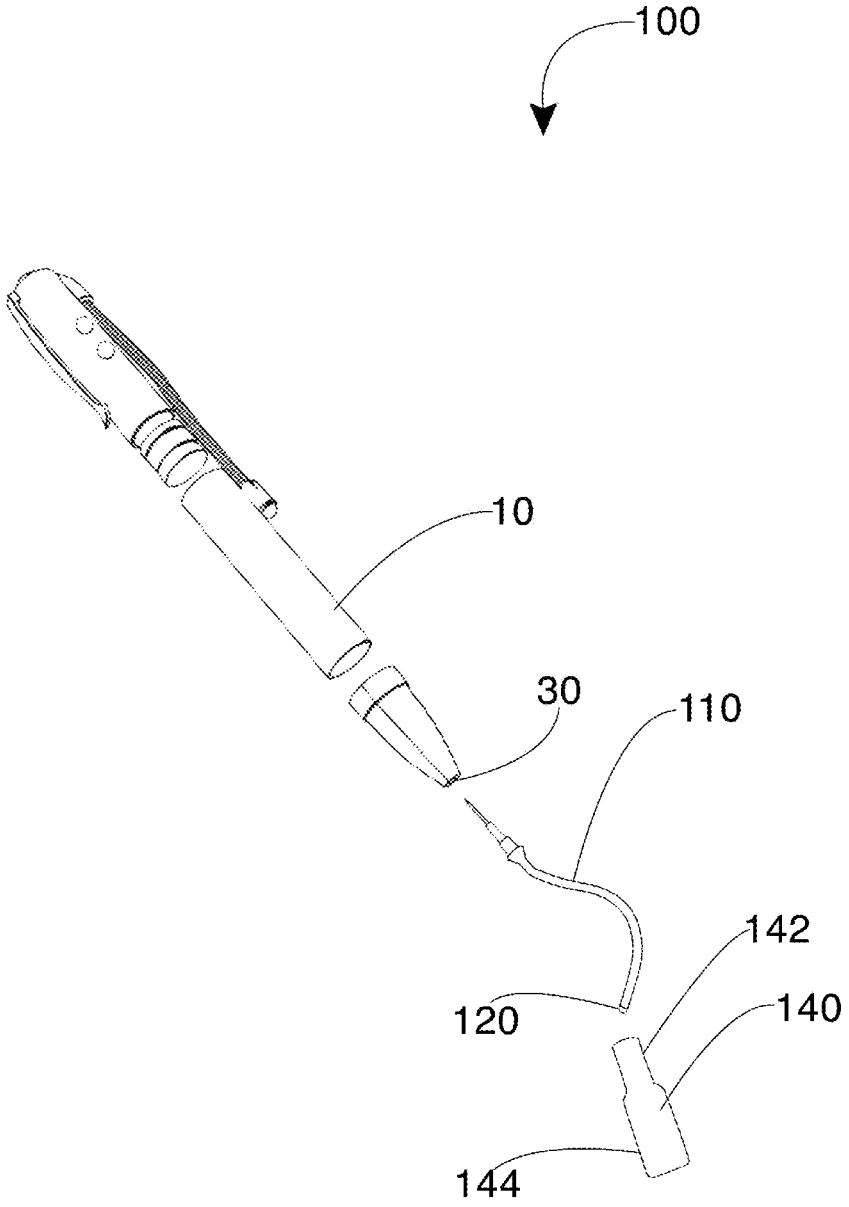
FIG. 2 is a perspective view of the writing instrument system of FIG. 1, according to an embodiment of the present disclosure.

FIG. 2 shows a perspective view of the writing instrument system 100 of FIG. 1, according to an embodiment of the present disclosure. As above, the writing instrument system 100 may include the elongated tip 110 having the nib 120 and the piercing tip 130 providing a retrofit attachment for a writing instrument providing improved form, allowing for increased control and comfort. The elongated tip 110 comprises the piercing tip 130 having a needle for inserting into the ink cartridge 10 or tube of a pen 20 for converting the pen 20 into an ergonomic writing instrument. The elongated tip 110 includes a curvature 112 having a hook-shape. The curvature 112 allows a user to view a point of contact of the nib 120 when using a pen 20 thereby improving precision, control, and comfort.

Figure 3:
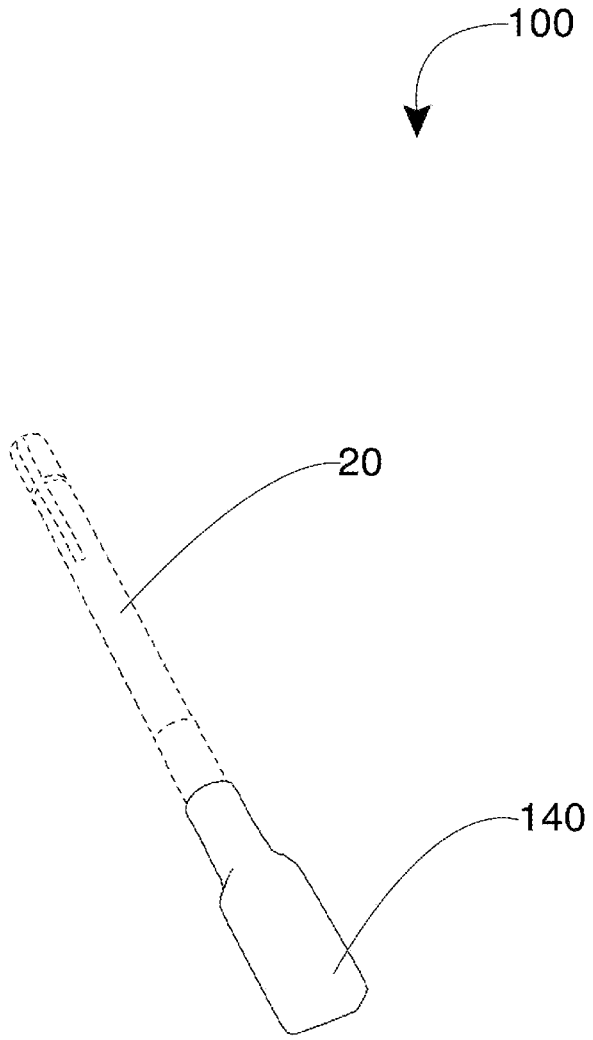
FIG. 3 is a perspective view of the writing instrument system of FIG. 1, according to an embodiment of the present disclosure.

FIG. 3 shows a perspective view of the writing instrument system 100 of FIG. 1, according to an embodiment of the present disclosure. As above, the writing instrument system 100 may include the elongated tip 110 which is removably attached to an ink-pen having the ink cartridge 10 or other pen 20. The elongated tip 110 comprises a curved metal funnel. Ink is transferred from the ink cartridge 10 to the nib 120 through the curved metal funnel of the elongated tip 110. The writing instrument system 100 further includes a cap 140 formed to allow the cap 140 to be placed over the elongated tip 110 and be removably affixed to a body of the pen 20 in which the elongated tip 110 is installed. The cap 140 may be transparent or non-transparent. The cap 140 comprises a narrow receiving end 142 and an enlarged housing portion 144 for receiving the elongated tip 110 having the curvature 112.

Figure 4:
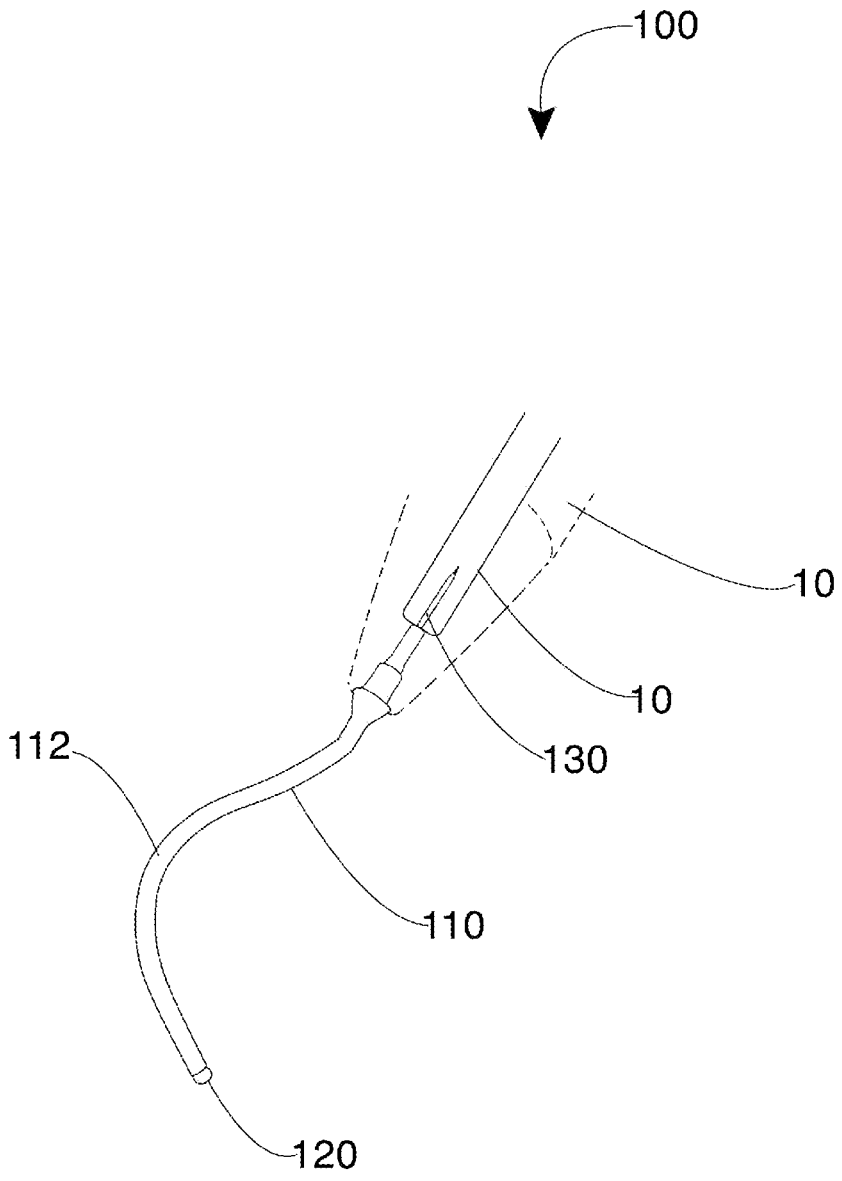
FIG. 4 is a perspective view of the writing instrument system of FIG. 1, according to an embodiment of the present disclosure.
Figure 5:
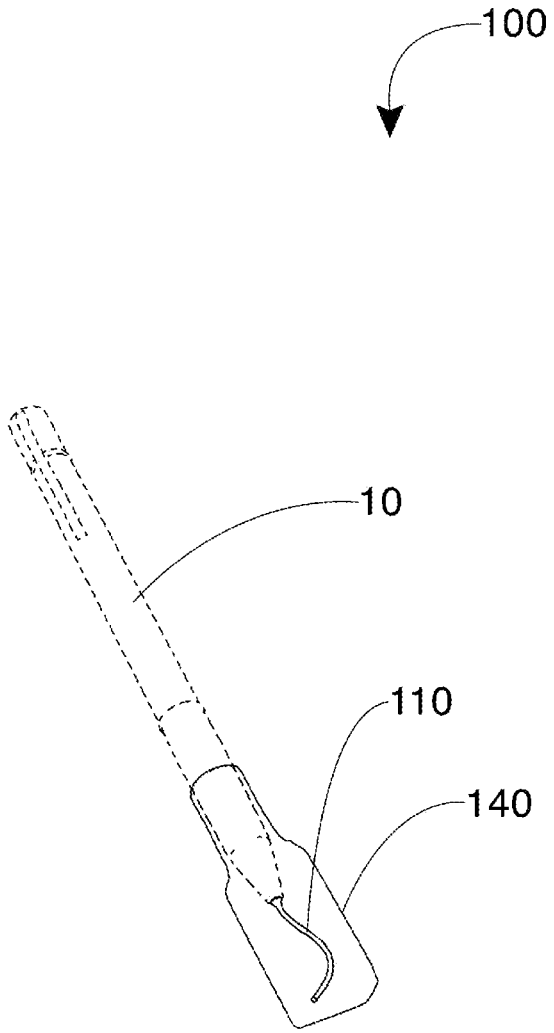
FIG. 5 is a perspective view of the writing instrument system of FIG. 1, according to an embodiment of the present disclosure.

FIGS. 4-5 show perspective views of the writing instrument system 100 of FIG. 1, according to an embodiment of the present disclosure. As above, the writing instrument system 100 may include the elongated tip 110 having the nib 120 positioned at the first-end 122 and the piercing tip 130 at the second-end 132. The nib 120 housed within the first-end 122 of the elongated tip 110 and extended therefrom. The second-end 132 of the elongated tip 110 further includes an adapter member 124. The adapter member 124 is configured to be inserted into an aperture 30 positioned at a pen tip and secure the elongated tip 110 at the pen tip within the aperture 30. The adapter member 124 comprises a cylindrical profile and is configured between the elongated tip 110 and the piercing tip 130. The nib 120 is firm and may comprise a material such as felt and plastic or other suitable material.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A writing instrument system comprising:
an elongated tip having;
a nib;
a curved metal funnel;
and
a piercing tip;
wherein said nib is positioned at a first-end of said elongated tip and said piercing tip is positioned at a second-end of said elongated tip;
wherein said elongated tip is in fluid communication with said nib;
wherein said piercing tip is configured to penetrate an ink cartridge of a pen such that said elongated tip is configured to connect to a pen end;
wherein said piercing tip is in fluid communication with said elongated tip and is adapted to allow ink to flow from a penetrated said ink cartridge through said elongated tip to said nib where said ink can be evenly dispensed and applied to a surface; and
wherein said elongated tip is an adapter and includes a curvature allowing a user to have a clear view of where said nib makes contact with said surface.

2. The writing instrument system of claim 1, wherein said piercing tip comprises a needle.

3. The writing instrument system of claim 1, wherein said elongated tip is configured to removably connect to said pen.

4. The writing instrument system of claim 3, wherein said elongated tip is configured to be retrofit to said pen.

5. The writing instrument system of claim 4, wherein said ink cartridge is adapted to be disposed in the pen.

6. The writing instrument system of claim 1, wherein said curved metal funnel of said elongated tip is adapted to transfer ink from said ink cartridge to said nib.

7. The writing instrument system of claim 1, wherein said curvature of said elongated tip comprises a hook-shape.

8. The writing instrument system of claim 1, wherein said nib is housed within said first-end of said elongated tip and extended therefrom.

9. The writing instrument system of claim 1, wherein said second end of said elongated tip further includes an adapter member.

10. The writing instrument system of claim 9, wherein said elongated tip is disposed within said adapter member and said adapter member is configured to be inserted into an aperture positioned at the pen end.

11. The writing instrument system of claim 10, wherein said adapter member comprises a cylindrical profile.

12. The writing instrument system of claim 9, wherein said adapter member is configured between said elongated tip and said piercing tip.

13. The writing instrument system of claim 1, wherein said nib is firm.

14. The writing instrument system of claim 13, wherein said nib comprises a material selected from the group consisting of felt and plastic.

15. The writing instrument system of claim 1, wherein said elongated tip is adapted to fit inside of a pen cap removably affixed to the pen.

16. The writing instrument system of claim 15, wherein said cap is transparent.

17. The writing instrument system of claim 15, wherein said cap is non-transparent.

18. The writing instrument system of claim 15, wherein said cap comprises a narrow receiving end and an enlarged housing portion for receiving said elongated tip having said curvature.

19. A writing instrument system, the writing instrument system comprising:

an elongated tip having;

a nib; and a piercing tip;

wherein said nib is positioned at a first-end of said elongated tip and said piercing tip is positioned at a second-end of said elongated tip;

wherein said elongated tip is in fluid communication with said nib;

wherein said piercing tip is configured to penetrate an ink cartridge of a pen such that said elongated tip is configured to connect to a pen end;

wherein said piercing tip is in fluid communication with said elongated tip and is adapted to allow ink to flow from a penetrated said ink cartridge through said elongated tip to said nib where said ink can be evenly dispensed and applied to a surface wherein said elongated tip is an adapter and includes a curvature allowing a user to have a clear view of where said nib makes contact with said surface;

wherein said piercing tip comprises a needle;

wherein said elongated tip is configured to removably connect to said pen;

wherein said elongated tip is configured to be retrofit to said pen;

wherein said ink cartridge is adapted to be disposed in the pen;

wherein said elongated tip comprises a curved metal funnel;

wherein said curved metal funnel of said elongated tip is adapted to transfer ink from said ink cartridge to said nib;

wherein said curvature of said elongated tip comprises a hook-shape;

wherein said nib is housed within said first-end of said elongated tip and extended therefrom;

wherein said second-end of said elongated tip further includes an adapter member;

wherein said elongated tip is disposed within said adapter member and said adapter member is configured to be inserted into an aperture positioned at;

wherein said adapter member comprises a cylindrical profile;

wherein said adapter member is configured between said elongated tip and said piercing tip;

wherein said nib is firm;

wherein said nib comprises a material selected from the group consisting of felt and plastic;

wherein said elongated tip is adapted to fit inside of a pen cap removably affixed to the pen; and wherein said cap comprises a narrow receiving end and an enlarged housing portion for receiving said elongated tip having said curvature.

* * * * *